US006174103B1

(12) United States Patent
Stroman

(10) Patent No.: US 6,174,103 B1
(45) Date of Patent: Jan. 16, 2001

(54) REMOVABLE/PORTABLE SPEED BUMP APPARATUS

(76) Inventor: Randall N. Stroman, 2354 Dayton Crest Cir., South Jordan, UT (US) 84095-3433

( * ) Notice: Under 35 U.S.C. 154(b), the term of this patent shall be extended for 0 days.

(21) Appl. No.: 09/205,034

(22) Filed: Dec. 4, 1998

(51) Int. Cl.[7] ..... E01F 11/00
(52) U.S. Cl. ..... 404/15
(58) Field of Search ..... 404/15, 16; 441/133

(56) References Cited

U.S. PATENT DOCUMENTS

| | | | | |
|---|---|---|---|---|
| 1,265,404 | | 5/1918 | Tuteur . | |
| 3,540,063 | * | 11/1970 | Stanwood . | |
| 3,880,537 | | 4/1975 | Harris et al. . | |
| 3,972,077 | * | 8/1976 | Whitten, Jr. | 4/496 |
| 4,697,294 | | 10/1987 | Schäfer . | |
| 4,813,811 | * | 3/1989 | Adams | 404/15 |
| 4,985,007 | * | 1/1991 | Ellis . | |
| 5,005,229 | * | 4/1991 | Bertoni | 4/505 |
| 5,460,113 | * | 10/1995 | Gunter | 114/230.2 |
| 5,639,179 | | 6/1997 | Jensen . | |
| 5,769,563 | | 6/1998 | Flynn . | |
| 5,775,834 | | 7/1998 | Jackson . | |

FOREIGN PATENT DOCUMENTS

| | | | | |
|---|---|---|---|---|
| 553295 | * | 8/1974 | (CH) | E01F/9/04 |
| 3243842 | * | 5/1984 | (DE) | 404/16 |
| 2596081 | * | 9/1987 | (FR) | E01F/9/04 |
| 2030197 | * | 4/1980 | (GB) | 404/15 |
| 2086967 | * | 5/1982 | (GB) | 404/16 |
| 2175335 | * | 11/1986 | (GB) | 404/16 |
| 91/19856 | * | 12/1991 | (WO) | 404/15 |

* cited by examiner

*Primary Examiner*—David Bagnell
*Assistant Examiner*—Gary S. Hartmann
(74) *Attorney, Agent, or Firm*—Thorpe, North & Western, L.L.P.

(57) ABSTRACT

A removable and portable speed bump system using a flexible connector such as a chain or cable lying transversely across the roadway, and a number of generally triangular, or arch-shaped, spaced-apart bump modules disposed on the speed bump for which cars must slow down to cross. The speed bump modules are either fastened to the flexible connector or molded directly onto the flexible connector. The flexible connector is attached to a connecting anchor fixed into the road curb or road shoulder of a roadway. The opposite end of the flexible connector is fastened to a clasp or spring-loaded link set at a second point transversely across the roadway from the connecting anchor. The speed bump modules are configured to enable stacking in a compact fashion, for example, in a special container located on the side of the roadway.

7 Claims, 5 Drawing Sheets

REMOVABLE/PORTABLE SPEED BUMP APPARATUS

BACKGROUND OF THE INVENTION

1. Field of the Invention

This invention relates generally to the field of vehicular traffic safety, and more particularly to a removable and portable speed bump which can be easily carried and/or stored on-site where the speed bump is intended to be deployed.

2. State of the Art

Speed bumps have been used for some time to slow down traffic in certain areas where the traffic speeds must be reduced, such as construction areas, school zones, parking lots, pedestrian zones and similar areas. Some speed bumps are permanent in nature and are made from asphalt or concrete. Permanent bumps or ramps are also used to guide traffic or indicate some change in traffic flow. These permanent speed bumps are useful but they have the disadvantage that they can not be moved or taken away when they are not needed. Other speed bumps exist which can be moved but are not easily stored at the desired site of the speed bump such as U.S. Pat. No. 3,880,537 to Jensen and U.S. Pat. No. 5,775,834 to Jackson. Such speed bumps typically are not as durable as one might desire and are unnecessarily complex to install.

Road hazard warning devices are also a common type of traffic control. These road hazard devices usually consist of visual markers like flags, signs, cones, or reflective barrels to warn oncoming vehicle traffic of road work or other road dangers. In some hazard situations, a flagman holds a flag to signal traffic hazards or the need for speed reduction. This is a dangerous job because the flagman is standing in traffic and it is usually temporary in nature. The flagman moves to sites where the flag is needed, and the positions where a flagman is needed change on a daily basis. Traffic passing a flagman will normally reduce its speed, but it would be helpful for the flagman to use a temporary speed bump or similar device which requires the traffic to slow down. A temporary speed bump would force traffic to reduce speed and in turn create a safer area for the flagman. In some situations, a temporary speed bump could even replace a flagman where the speed of the traffic is only being controlled and there is no need to control the traffic flow. A temporary speed bump is needed which can be deployed for a short periods, for example, for just a day or a few hours at a time in a school zone. It would also be an advantage if the speed bump could be set up and removed in minutes.

Highway warning devices exist, such as U.S. Pat. No. 5,775,834 to Jackson and U.S. Pat. No. 5,769,653 to Flynn, which create an audible warnings as cars drive across. These prior art devices warn drivers of impeding hazards with rib or wave like structures but they do not require vehicles to slow down to cross their warning structures. The ribs or waves are large enough to create an audible warning and slight vertical motion when vehicles cross them but these structures do not vehicles to reduce their speed.

Existing temporary traffic hazard systems may be portable and deployed when needed but these systems have disadvantages. Typical temporary road hazard markers are not fastened in place but remain in place by their own weight as taught by U.S. Pat. No. 3,880,537 to Harris and U.S. Pat. No. 5,639,179 to Jensen. Many traffic hazard markers such as those disclosed by Jensen also rely on the weight of the units to hold them in place by attaching the modules together. Such traffic speed bumps or markers are not particularly attached to the road surface which may allow them to move or be knocked down when crossed by a vehicle or affected by wind and weather conditions.

The current invention overcomes the disadvantages of the prior art by providing a stable traffic speed bump system which can be used temporarily and then stored after it has been used.

OBJECTS AND SUMMARY OF THE INVENTION

It is an object of the invention to provide a movable and portable speed bump system which is easy to setup on or remove from a roadway.

It is a further object of the invention to provide a movable speed bump which can be readily removed and stored, for example, during snow removal or road and parking lot cleaning, etc.

It is still a further object of the invention to provide a speed bump system which allows the flow of water therepast.

The present invention is a removable and portable speed bump system using a flexible connector such as a chain or cable lying transversely across the roadway, and a number of generally triangular, or arch-shaped, spaced-apart bump modules disposed on the connector for which cars must slow down to cross. The speed bump modules are either fastened to the flexible connector or molded directly onto the flexible connector. The flexible connector is attached to a connecting anchor fixed into the road curb or road shoulder of a roadway. The opposite end of the flexible connector is fastened to a clasp or spring-loaded link set at a second point transversely across the roadway from the connecting anchor.

The speed bump modules are configured to enable stacking in a compact fashion, for example, in a special container located on the side of the roadway.

DETAILED DESCRIPTION

Figure 1:
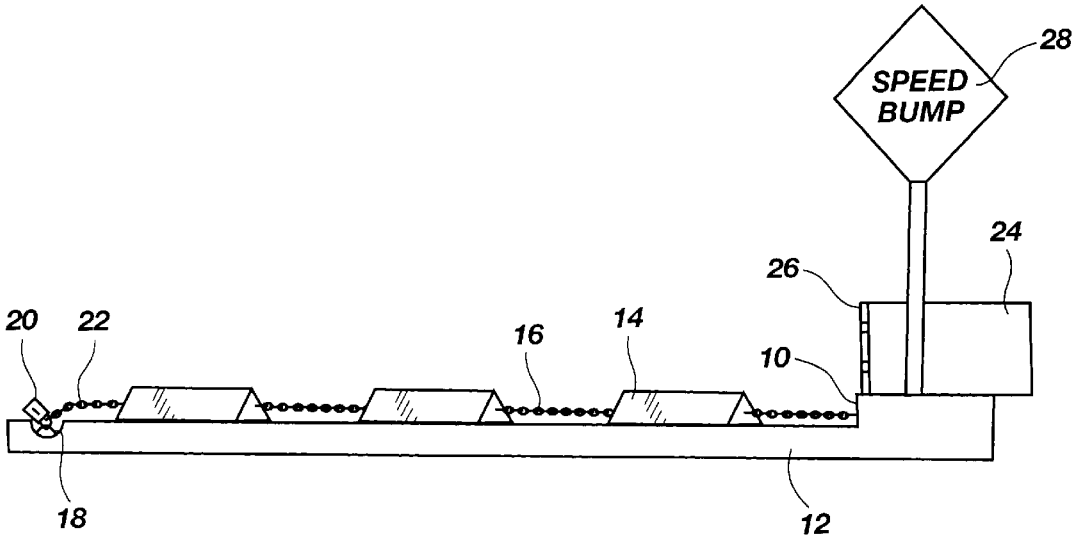
FIG. 1 is a perspective view of a movable speed bump system made in accordance with the present invention.

FIG. 1 illustrates the preferred embodiment of the invention and shows the removable and portable speed bump across a roadway. The invention forces vehicles which pass over the speed bump to reduce their speed to avoid the uncomfortable jarring motion that is created if the speed bump is crossed quickly. The speed bump is attached to the roadway 12 with a connecting anchor 10. The anchor in the preferred embodiment is an eyebolt which can be secured into the roadway curb or into the shoulder of the road. It should be noted that one who is skilled in the art could devise other methods which would attach the speed bump to the roadway, curb or road shoulder such as metal loops, bolts, screws or the like.

The speed bump itself consists of a number speed bump modules which are elongated rigid bodies arranged in a series. In the preferred embodiment, these speed bump modules can be made of any number of materials including but not limited to rubber, plastic, recycled plastic, rubber covered metal or any other similar material which is partially deformable. It should be noted at this point that the modules in the preferred embodiment of the invention are generally solid and only slightly deformable as a result. If the bumps are very deformable they will not be effective and the result is a speed bump where vehicles do not reduce their speed. Although speed bumps have been devised which are hollow and hollow speed bumps can be substituted for the solid bumps of this invention, solid speed bumps generally wear better. Solid speed bumps also sit better on the road surface because of their weight. The speed bump modules can be made of materials which are not deformable such as concrete or metal but these are not preferred because they are not as easily transportable, light, or movable.

The speed bump modules are connected by flexible connectors 16 to form an alternating series of speed bump modules and connectors. The flexible connectors in the preferred embodiment are metal chains but the connectors could also be plastic chains, plastic connectors, rubber connectors, metal cables, rubber coated cables or chains or any similar type of flexible connector. It should be noted that these connectors must be strong enough to withstand vehicle tires passing over them and the forces created by vehicle traffic. Enough slack is left in the connectors or chains between each set of speed bump modules to allow the chain to touch the road surface when a vehicle passes over it.

At the opposite side of the road is a fastener 18 to which the series of speed bump modules can be attached. This fastener in the preferred embodiment is a strong loop 18 made of metal or similarly strong material or plastic, which is recessed into the road surface. An attachment link 20 connects the fastening loop 18 to the last flexible connector 22 in the speed bump series. The link is a quick link, a snap spring link or a normal lock. The preferred attachment link is a connector that can be attached or detached in a matter of seconds. Another embodiment of the fastener would be a pop-up eyelet mounted flush to the ground in a mounting bracket. It is also conceivable that a hook, looping method or any other type of well known method for connecting a chain or cable to the strong loop 18 could be used.

Another important part of this invention, which is shown in FIG. 1, is the storage container 24 which is attached to the road side or curbside next to the speed bump anchor. The storage container 24 has a door 26 which opens and then the speed bump modules 14 are stacked inside the storage container 24 and the door 26 is shut and locked. This is a very convenient method for using the speed bump modules because they are stored next to the location where they are used. A warning signal with a fold over sign 28 can also be attached to the storage box to indicate that a speed bump has been deployed. The sign is folded over when the speed bump is stored in the container and displayed when the speed bump is in use. In another embodiment of this invention (not shown), the speed bump modules can be anchored to the storage container so they can be stacked in the storage container which is be fastened to the road side. If the speed bump modules are attached to the storage container and the container is not fastened to the roadway then the container and the speed bump modules can be moved as desired. This configuration is especially useful for a speed bump in a temporary construction zone.

In an alternative embodiment, the speed bump can be deployed on an unfinished road surface such as a dirt road or gravel at a construction site. With this configuration, a stationary point is required to attach the connecting anchor 10 into the road side and another stationary point is needed to attach the removable fastener 18 into the transverse road side. The anchor and fastener can be connected to a piece of concrete in the road shoulder, a heavy cement block, a metal anchoring block, or similar anchoring structures. This is an advantage over the prior art which would be difficult to install on an unfinished road surface because they need to be fixed into a finished road surface.

Figure 2:
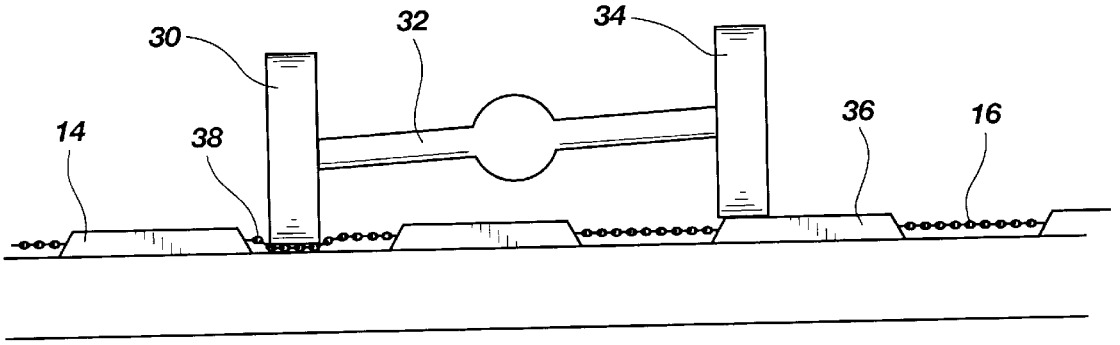
FIG. 2 is a front view of the speed bump system showing the wheel base and tires of a vehicle passing over the movable speed bumps.

Now referring to FIG. 2, which is a front view of the speed bump system, the invention has the advantage that a vehicle driver who carefully drives across the speed bump may guide the vehicle's tire 34 to cross only one speed bump module 36 while the other tire 30 will cross a connecting member or chain 38. A vehicle driver who avoids driving one tire 30 over the speed bump modules 14 reduces the jarring motion felt by the passengers of the vehicle but the vehicle must still reduce its speed. In addition, allowing the driver to avoid one speed bump is easier on the vehicle's suspension 32.

Figure 3:
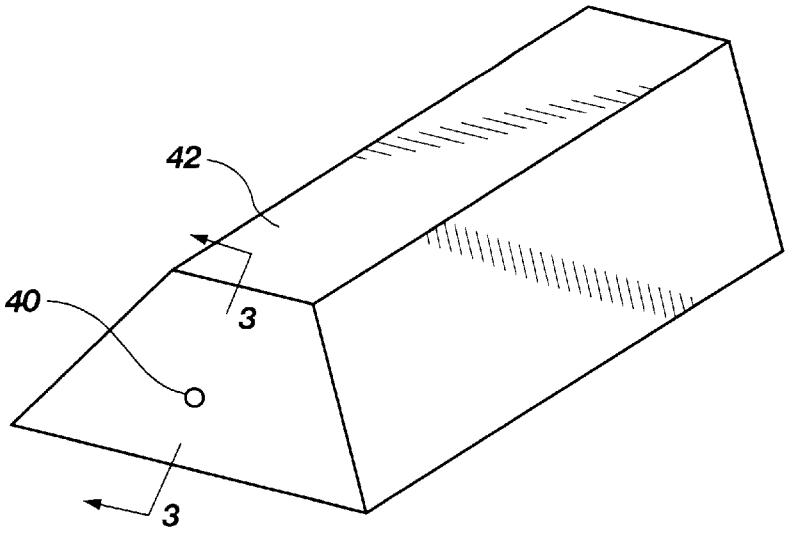
FIG. 3 is a side perspective view of one speed bump module showing the preferred generally triangular shape of the speed bump modules.

FIG. 3 is a perspective view of a triangular shaped type of elongate member or speed bump module. It can be seen in this invention that the speed bump is triangular in shape, but there is no apex of the triangle. Even though a triangular shape with an apex can be used in this invention, the flattened top surface 42 of the speed bump allows vehicles to more easily pass over the speed bump. The speed bump modules also have a cylindrical aperture or hole 40 in the end of the bump. This hole 40 allows a screw or screw type bolt to be fastened into the speed bump. The preferred embodiment of this invention uses an eyebolt which has a threaded end to screw into the speed bump. The eyebolts are then coupled to the flexible connectors to connect the speed bump modules together. In one embodiment of the invention, metal chains used as connectors would be manufactured with the eyebolts already connected to the metal chain.

In an alternative embodiment, the cylindrical hole runs completely through the speed bump module to allow a flexible connector to pass through the speed bump. This allows the speed bump modules to be connected with one flexible line which runs through the center of all the modules instead of using multiple connectors. In this embodiment, pins would be used at the module ends or inside the modules to couple the speed bump modules to the flexible line so that the speed bump does not rotate or move lengthwise on the line. Alternatively, the speed bump modules could be crimped or formed such that the speed bump can not move lengthwise on the flexible line or chain.

Figure 4:
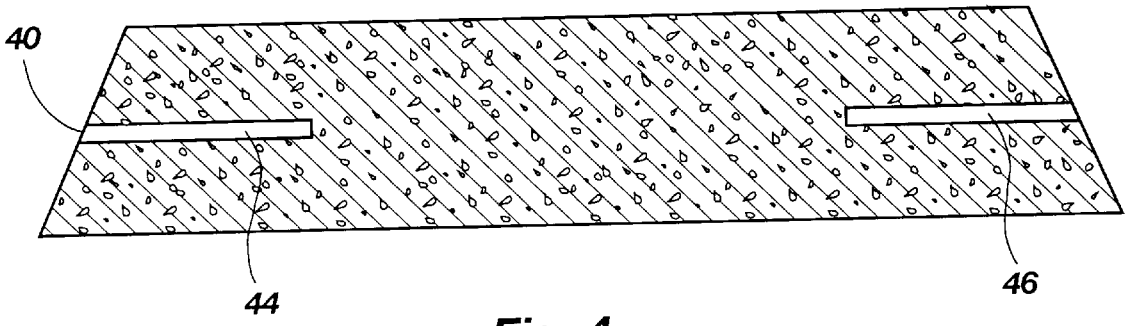
FIG. 4 is a cross cut side view of a single speed bump module in the speed bump system.

FIG. 4 is a cross cut view of the speed bump in FIG. 3 on the line 3—3. The cylindrical hole 40 for fastening eyebolts is shown, along with the cylindrical shafts 44 and 46 into which the eyebolts are threaded. The cylindrical shafts 44 and 46 could also be one continuous cylindrical shaft which passes through the speed bump.

Figure 5A:
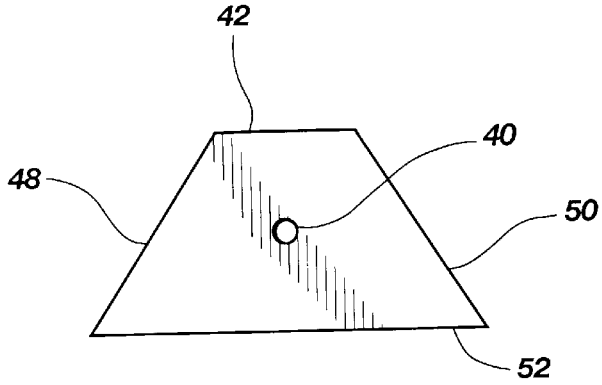
FIG. 5A is an end view of a speed bump module showing a triangular embodiment.

FIG. 5A is an end view of a speed bump module where the shape of the bump is somewhat triangular in shape. The cylindrical hole 40 for fastening bolts is shown along with a top surface 42 which replaces the apex of the triangular shape, two triangularly angled sides 48 and 50, and a flat bottom 52 which is designed to sit on the road surface.

Figure 5B:
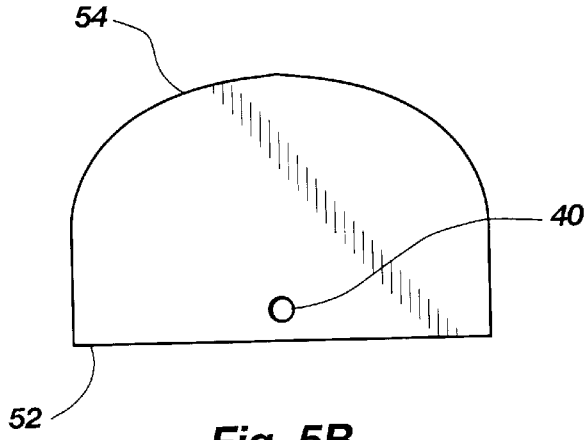
FIG. 5B is an end view of a speed bump module with an arched embodiment used in the speed bump system.

FIG. 5B is the end view of another embodiment of a speed bump module with an arched shape. This figure shows the arched shaped top surface 54 which forms the bump, the cylindrical hole 40 for fastening bolts, and the flat bottom 52 as described above. The cylindrical hole in FIG. 5B is shown closer to the bottom of the speed bump to illustrate that the point where the flexible connector is secured to the speed bump may be varied depending on the connector used or the amount of slack desired between the speed bump modules.

Figure 5C:
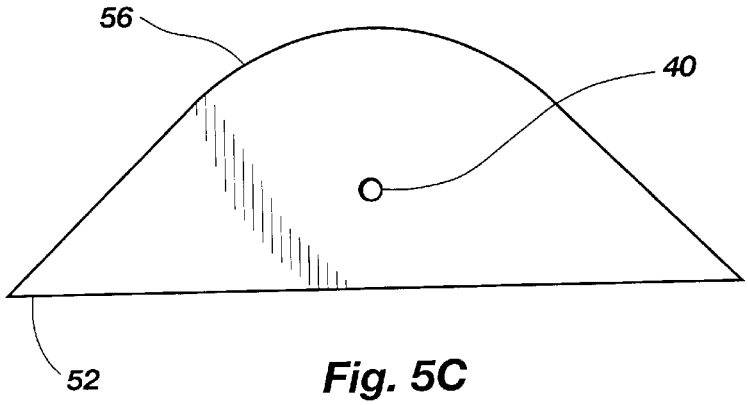
FIG. 5C is an end view of a speed bump module with a dome shape used in the speed bump system.

FIG. 5C is another end view of an embodiment which is a dome shape. This figure shows the dome shaped top surface 56, the cylindrical hole 40 for fastening bolts and the flat bottom surface 52 which is designed to sit on the roadway.

The speed bump modules in the preferred embodiment are approximately 1–6 inches high with 4 inches being the preferred height. The speed bump modules have a width which increases depending on the height, and they are approximately 24 inches in length. Further, the preferred length of the flexible connectors between each speed bump is approximately 18 inches. The preferred length arrangement between the speed bump modules and the flexible connectors is such that if a vehicle (car or truck) with an axle length of between 56–70 inches avoids a speed bump with one wheel, the vehicle will drive over a speed bump with the other wheel. It should be recognized that the speed bump modules could be of various heights, widths and lengths, as long as the dimensions are sufficient to require a car to slow down to comfortably drive over the bump and not so tall that a car could not drive over it.

Figure 6A:
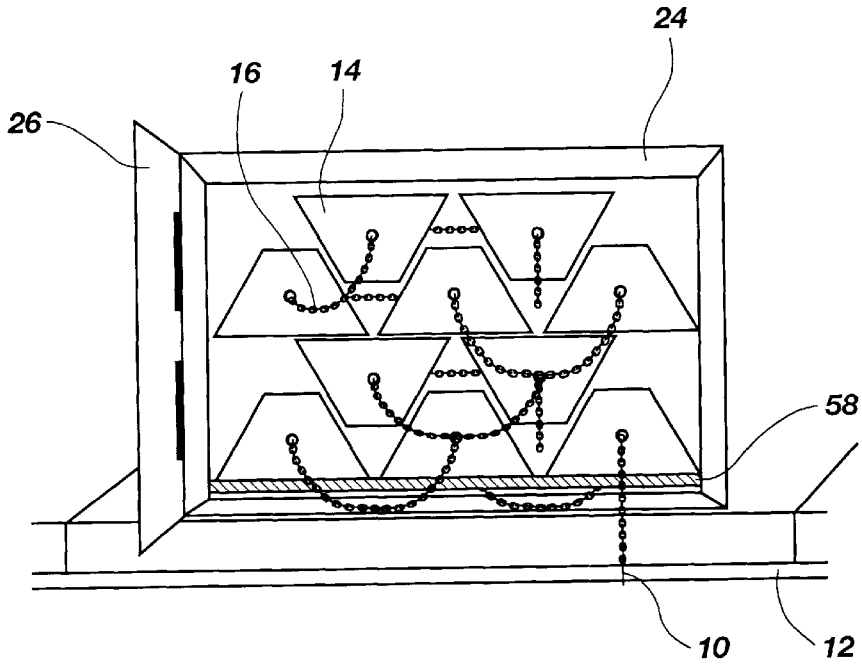
FIG. 6A is a side view of the speed bump system showing the speed bump modules stacked in a storage container.

In FIG. 6A the speed bump modules 14 linked by the flexible connectors 16, are shown stacked on a shelf 58 in a storage container 24 with a door 26. The first flexible connector 16 is shown attached to the connecting anchor 10 which is secured into the roadway 12 or road curb.

Figure 6B:
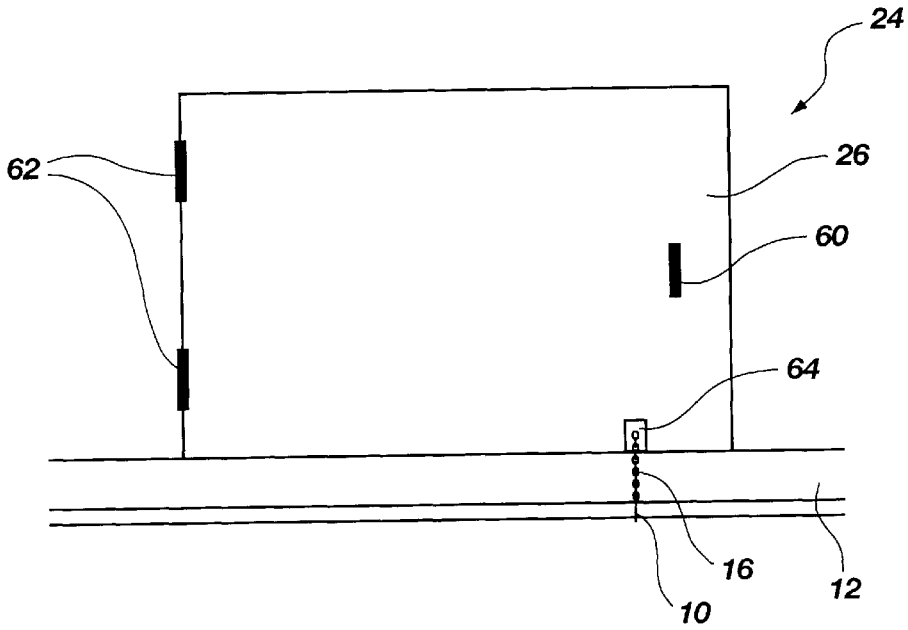
FIG. 6B is a view of the speed bump system showing the speed bumps stacked in a storage container with the container door closed.

In FIG. 6B the speed bump modules are stacked in the storage container 24 with the door 26 closed. The door handle 60 and door hinges 62 are also shown. The first flexible connector 16 is shown attached to the anchor 10 which is secured into the road 12 or road curb. The first flexible connector 16 is seen passing through an aperture or hole 64 in the container door 26 so that the speed bump modules stay connected to the anchor 10 in the roadside.

Figure 7:
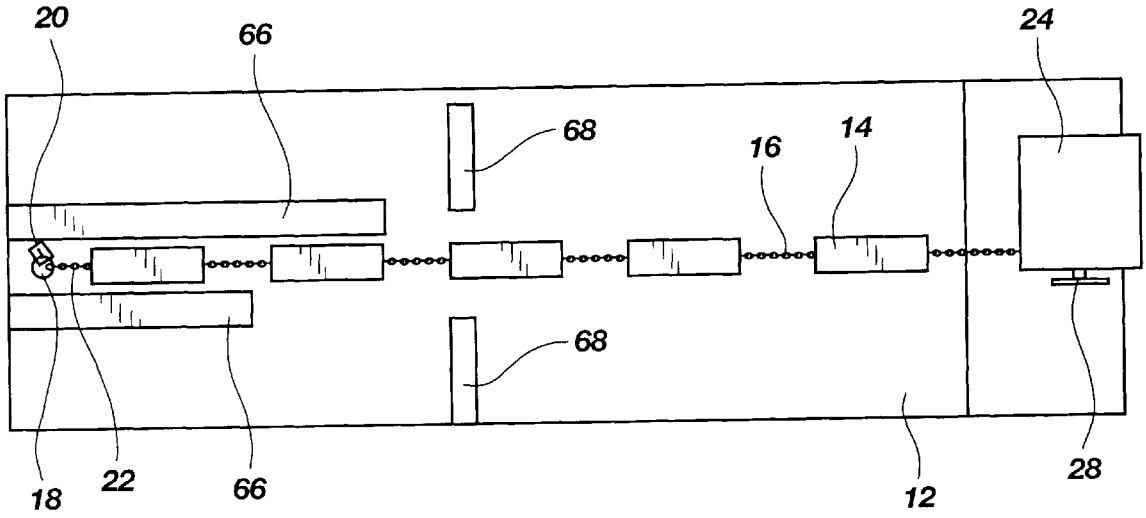
FIG. 7 is a top view of the speed bump system showing a speed bump with flourescent or reflective lines painted next to the speed bump system.

FIG. 7 shows a top view of the speed bump modules when they are deployed for use. This figure shows flourescent lines 66 painted on either side of the speed bump modules and it also shows the lane divider lines 68 on the roadway.

It will be appreciated that other embodiments of the present invention may be employed in many applications to accomplish a removable and portable speed bump. While certain preferred embodiments have been explained above, the appropriate scope hereof is deemed to be in accordance with the claims as set forth below.

What is claimed is:

1. Removable and portable speed bump apparatus for placing across the road comprising:

a plurality of substantially elongated rigid bodies having an underside, a top surface, a first end and a second end, wherein the underside is flat in order to be disposed on a road surface, the top surface forming a bump with the underside;

a plurality of intermediate connectors to connect the elongated rigid bodies, wherein the elongated rigid bodies and the intermediate connectors alternately interconnect to form a chain having a first and second end;

a fastening anchor configured to be permanently fixed into a road side;

a first connector to permanently connect the first end of the chain to the fastening anchor;

a fastener to removably attach the second end of the chain to a point located on the opposing road side;

a storage container with a door, disposed adjacent to the fastening anchor to receive the plurality of connected elongated rigid bodies for storage; and an aperture formed in the storage container door such that the first connector can pass through the aperture while the first connector is still attached to the fastening anchor in the roadway.

2. The speed bump apparatus as in claim 1 where the elongated rigid bodies further have a length of approximately 24 inches and a height of approximately 4 inches.

3. The speed bump apparatus as in claim 1 wherein of the intermediate connectors has a length to allow a vehicle's tire to pass through without contacting the elongated rigid bodies.

4. The speed bump apparatus according to claim 1 where the elongated rigid bodies further comprise a plurality of substantially elongated rigid bodies with a flat underside and a generally arched top surface connected to the underside to form a substantially rigid body.

5. The speed bump apparatus according to claim 1 where the elongated rigid bodies are further comprised of a partially deformable material.

6. The speed bump apparatus according to claim 5 where the partially deformable material of the elongated rigid bodies is further comprised of materials selected from the group consisting of rubber, plastic and rubber coated metal.

7. The speed bump apparatus as in claim 6 where the elongated rigid bodies are further comprised of reflective material embedded into the partially deformable material.

* * * * *